United States Patent [19]

Noren et al.

[11] 4,194,079

[45] Mar. 18, 1980

[54] HEATING ELEMENT AND ELECTRODE ASSEMBLY FOR HIGH TEMPERATURE FURNACES

[75] Inventors: Robert C. Noren; Michael H. Spritzer, both of San Diego, Calif.

[73] Assignee: General Atomic Company, San Diego, Calif.

[21] Appl. No.: 885,909

[22] Filed: Mar. 13, 1978

Related U.S. Application Data

[63] Continuation-in-part of Ser. No. 721,819, Sep. 9, 1976, abandoned.

[51] Int. Cl.[2] ..... H05B 3/62

[52] U.S. Cl. ..... 13/25

[58] Field of Search ..... 13/25, 20; 219/541, 219/552

[56] References Cited

U.S. PATENT DOCUMENTS

| | | | |
|---|---|---|---|
| 1,443,580 | 1/1923 | Little | 13/25 X |
| 1,448,388 | 3/1923 | Colby | 13/25 |
| 1,456,865 | 5/1923 | Brace | 13/25 |
| 2,359,157 | 9/1944 | Roth | 13/25 X |
| 2,679,545 | 5/1954 | Kistler | 13/25 X |

*Primary Examiner*—R. N. Envall, Jr.

*Attorney, Agent, or Firm*—Fitch, Even & Tabin

[57] ABSTRACT

In a high temperature furnace adapted for fuel particle coating applications, an electrode ring forms a portion of the furnace wall, heating elements within the furnace being urged into conductive engagement with an internal surface of the electrode ring by means of adjustable spring mechanisms arranged outside the furnace and interconnected with the heating elements by elongated bolts in order to permit adjustment of the spring load without interrupting operation of the furnace. The spring mechanism provides nearly constant contact pressure between the heating elements and the electrode ring surface under varying thermal and physical conditions and prevents overheating and failure of the electrode ring.

11 Claims, 3 Drawing Figures

HEATING ELEMENT AND ELECTRODE ASSEMBLY FOR HIGH TEMPERATURE FURNACES

This is a continuation-in-part of Ser. No. 721,819 filed Sept. 9, 1976, now abandoned.

BACKGROUND OF THE INVENTION

The present invention relates to high temperature furnaces preferably of a type employed for nuclear fuel particle coating, and more particularly to an electrode ring assembly for maintaining proper electrical contact between a heating element in the furnace and an external bus bar.

Many applications for high temperature furnaces require generally continuous or intermittent operation of the furnace over long periods of time where it is undesirable to interrupt operation of the furnace. The present invention particularly contemplates a high temperature furnace of this type employed in the coating of nuclear fuel particles. In order to protect the material forming the fuel particles, it is well known to coat them with pyrolytic carbon or metallic carbide for example. The coatings provide impermeability to retain gaseous and metallic fission products within the fuel particles. At the same time, the coatings tend to provide structural integrity even during prolonged exposure to high temperatures and irradiation conditions encountered within typical nuclear reactor operations.

A preferred method for coating nuclear fuel particles with such materials comprises the deposition of the coating material through the decomposition at high temperature of materials such as gaseous hydrocarbons. Such a coating operation is commonly performed by using a fluidized bed process to permit intimate contact between the reactant hydrocarbon gas and a bed of nuclear fuel particles. Fluidized bed coating apparatus may employ a reactor including a coating chamber arranged within a high temperature furnace of the type provided by the present invention. The necessary high temperatures are produced by one or more electrical resistive heating elements arranged within the furnace.

The furnace may commonly be formed as a cylindrical chamber with an annular arrangement of the heating elements serving to radiantly heat the interior of the furnace. The reactor may then simply be arranged within the interior of the high temperature furnace for carrying out the coating operation at a suitable high temperature.

Such a coating operation may continue over extended periods of time with temperatures in the furnace being rapidly cycled over a wide temperature range. This condition of rapid thermal cycling causes substantial expansion and contraction of electrical connections for the heating element and tends to result in loosening of the joints over a period of time. Such looseness naturally contributes to low contact pressure between the heating element and an electrode element for connecting the heating elements with a source of electrical energy. Local overheating may thus occur and eventually result in failure of the furnace to maintain proper temperature limits.

In the past, it has been necessary to interrupt operation of the furnace and cool the furnace interior in order to permit adjustments in the connections between the heating elements and electrodes. This of course has resulted in undesirable downtime which detracts from efficient operation. Also, the loosening of the contact surface may not be detected until failure of the electrode ring occurs due to overheating.

Accordingly, there has been found to remain a need for a high temperature furnace wherein proper contact may be assured and maintained between heating elements arranged within the furnace and an external bus bar supplying electrical energy to the furnace.

SUMMARY OF THE INVENTION

It is therefore an object of the present invention to provide a high temperature furnace including an assembly for uniformly maintaining an effective interconnection between one or more heating elements arranged within the furnace and an external bus bar.

It is a more particular object of the invention to provide such a high temperature furnace whrein the interconnection is achieved by means of a spring mechanism which is adjustable outside of the furnace while being coupled with the heating element for urging it into uniform electrical contact with an electrode surface. Being located outside the furnace, the spring mechanism is sufficiently cool so that its spring force will not relax or decrease excessively over long periods of furnace operation.

It is yet another object of the invention to provide such an assembly within a fuel particle coating furnace wherein a plurality of heating elements are arranged in circumferential relation along an internal conductive surface of an electrode ring forming a peripheral wall portion of the furnace.

Preferably, in achieving the above-noted objects, the electrode ring is penetrated by one or more openings adjacent each heating element, an elongated member being engaged with one of the heating elements and extending through each opening for connection with the adjustable spring means which may thus function to uniformly urge each heating element into intimate, electrically conductive relation with an internal conductive surface of the electrode ring. The electrode ring of course also includes means for connecting the internal conductive surface with a bus bar outside of the furnace.

Additional objects and advantages of the invention are made apparent in the following description having reference to the accompanying drawings.

DESCRIPTION OF THE PREFERRED EMBODIMENTS

Figure 1:
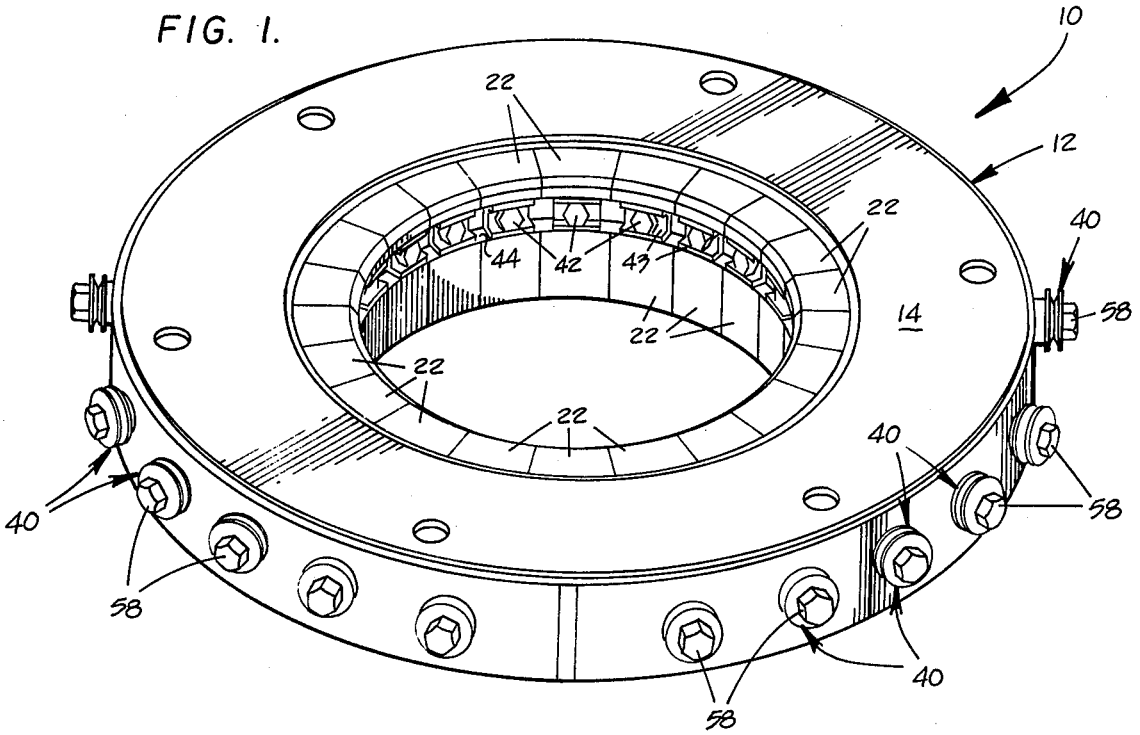
FIG. 1 is a perspective view of a heating element and electrode ring assembly employable in a fuel particle coating furnace.

A heating element and electrode assembly for maintaining an effective interconnection between a heating element in a furnace and an external bus bar is illustrated in the drawings in a configuration particularly adapted for use in a high temperature fuel particle coating furnace. However, it will be apparent from the following description that the heating element and electrode assembly may also be employed in other high temperature furnaces where it is desirable to maintain uniform contact between a heating element and an electrode without necessarily interrupting operation of the furnace. A similar interconnection may also be employed to form a return path for completing the circuit between the heating element and bus bar, if desired.

Figure 2:
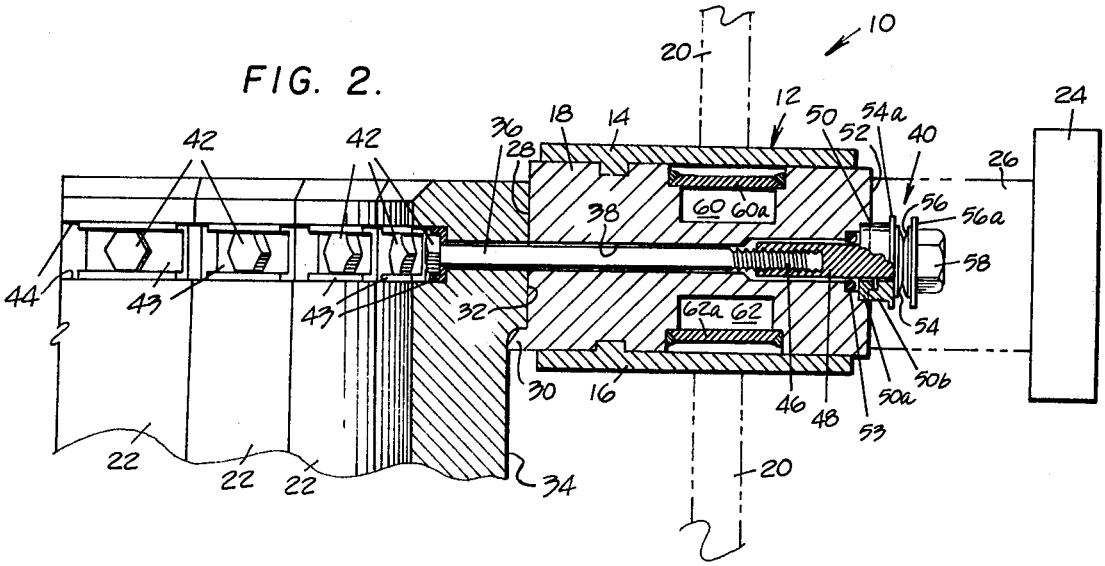
FIG. 2 is a radially sectioned view of the heating element and electrode ring assembly of FIG. 1 including a fragmentary portion of a peripheral wall structure for the furnace.

Referring particularly to FIG. 2, a heating element and electrode ring assembly is generally indicated at 10. The electrode ring assembly is indicated at 12 as a fabricated annular structure with upper and lower insulating plates 14 and 16 secured to opposite sides of a conductive electrode ring 18. The electrode ring structure 12 forms a peripheral wall portion of the furnace which is represented in FIG. 2 by fragmentary portions of the furnace wall or liner as indicated at 20. The electrode ring 18 is preferably formed as a plurality of circumferentially arranged segments which are insulated from each other in order to accomodate connection of the ring with a three-phase power supply without causing a short in the electrode assembly.

As described above, the electrode ring assembly 12 provides an effective electrical connection between an external bus bar and one or a plurality of heating element segments 22 arranged inside the furnace. The external bus bar, partially indicated at 24, is of a conventional type for supplying electrical power to the furnace. As a general indication of the power level for the furnace, it is contemplated that the juncture between the bus bar 24 and the heating element segments 22 may have a maximum current density of 400 amps. per sq. in., for example. The conductive ring 18 is interconnected with the bus bar 24 by means of one or more connecting elements such as that indicated at 26. The connecting element 26 is a conventional coupling means arranged external of the furnace for interconnecting the electrode ring assembly 12 with the bus bar.

The electrode ring 18 also forms an annular conductive surface 28 which is electrically connected with the bus bar 24. The conductive surface 28 arranged within the furnace wall 20 provides the means by which the heating element segments 22 are maintained in electrically conductive relation with the electrode ring 18 of the electrode ring assembly 12. The conductive surface 28 is formed with an annular boss 30 which is received between relatively stepped surfaces 32 and 34 of each heating element 22.

As indicated above, the present invention particularly contemplates an arrangement for continuously urging each of the heating element segments 22 into intimate electrically conductive relation with the internal conductive surface 28 at a uniform level over long periods of operation. The invention accomplishes this by means of an elongated bolt 36 which engages each heating element and extends through a radial opening 38 in the electrode ring 18 for interconnection with a spring mechanism 40. The spring mechanism 40 is arranged outside of the furnace so that the force with which the bolt 36 acts upon the heating element segments 22 may be adjusted even during operation of the furnace to maintain the proper contact pressure between the heating element segments 22 and the conductive surface 28.

Referring again particularly to FIG. 2, each elongated bolt 36 is formed with a head 42 which acts through a shaped washer 43 to engage an annular slot 44 in the plurality of heating element segments 22. The washers 43 spread the load of the bolt heads over a larger area of graphite along the slot 44 while also preventing the bolt heads from turning in the slot 44. The other end of the bolt 36 is threaded at 46 for engagement with a spring retainer 48. The spring retainer 48 extends through a spring adapter 50 which engages an external surface 52 of the electrode ring 18. A pair of opposed Belleville-type springs 54 and 56 are arranged between the spring adapter 50 and the head 58 of the spring retainer 48. The spring adapter 50 is a two-piece assembly including an insulator ring **50*a* and a spring retainer 50*b*. The insulator ring 50*a* bears against the surface 52. The spring retainer 50*b* backs up the insulator ring 50*a* and interacts with the Belleville spring 54. An O-ring 53 forms a seal between the electrode ring 18, spring retainer 48 and insulator ring 50*a*. The insulating ring 50*a* could possibly be omitted from the spring adapter assembly with the O-ring 53 bearing directly against the spring retainer 50*b*. Flat washers 54*a* and 56*a* are associated with the Belleville springs 54 and 56 to bear respectively against the spring retainer 50*b* and the bolt head 58**.

In this manner, the tension or force exerted between the surface 52 and the spring retainer 48 by the springs 54 and 56 may be adjusted by turning the spring retainer and either lengthening or foreshortening the distance between the head 58 of the spring retainer and the head 42 of the bolt 36. Accordingly, the contact pressure between the heating element segments 22 and the internal conductive surface 28 may be accurately adjusted in order to assure proper electrical contact between the heating element segments 22 and the electrode element 18.

Referring particularly to FIG. 1, it may be seen that a similar spring-loaded connection is provided for each of the plurality of heating element segments 22 arranged circumferentially along the internal conductive surface 28. The proper contact pressure between the heating element segments 22 and the conductive surface 28 may be maintained even during operation of the furnace by adjusting the respective spring retainer heads 58. As indicated above, the washer 43 prevents the bolt heads 42 from turning during adjustment of the spring tension. The present spring arrangement in practice, seldom needs adjustment because interaction of the springs 54 and 56 tends to promote self-adjustment. Any differential thermal expansion, strain or creep that would tend to loosen the contact joint may be compensated for, however, by adjusting the spring retainer heads 58.

The conductive electrode ring 18 is formed with a pair of annular passages 60 and 62. The passages are closed by biased cap plates **60*a* and 62*a*. The passages 60 and 62 permit the circulation of coolant in order to prevent high temperatures generated by the heating element segments 22 from being conducted along the electrode ring 18** to external parts of the furnace as well as to prevent overheating.

Rings 14 and 16 are electrical insulation rings secured to the electrode ring 18 by epoxy and provided with preferential leak paths to the exterior of the furnace in case a cap joint fails. This feature insures that a coolant leak will be exterior to the furnace and can be detected.

Figure 3:
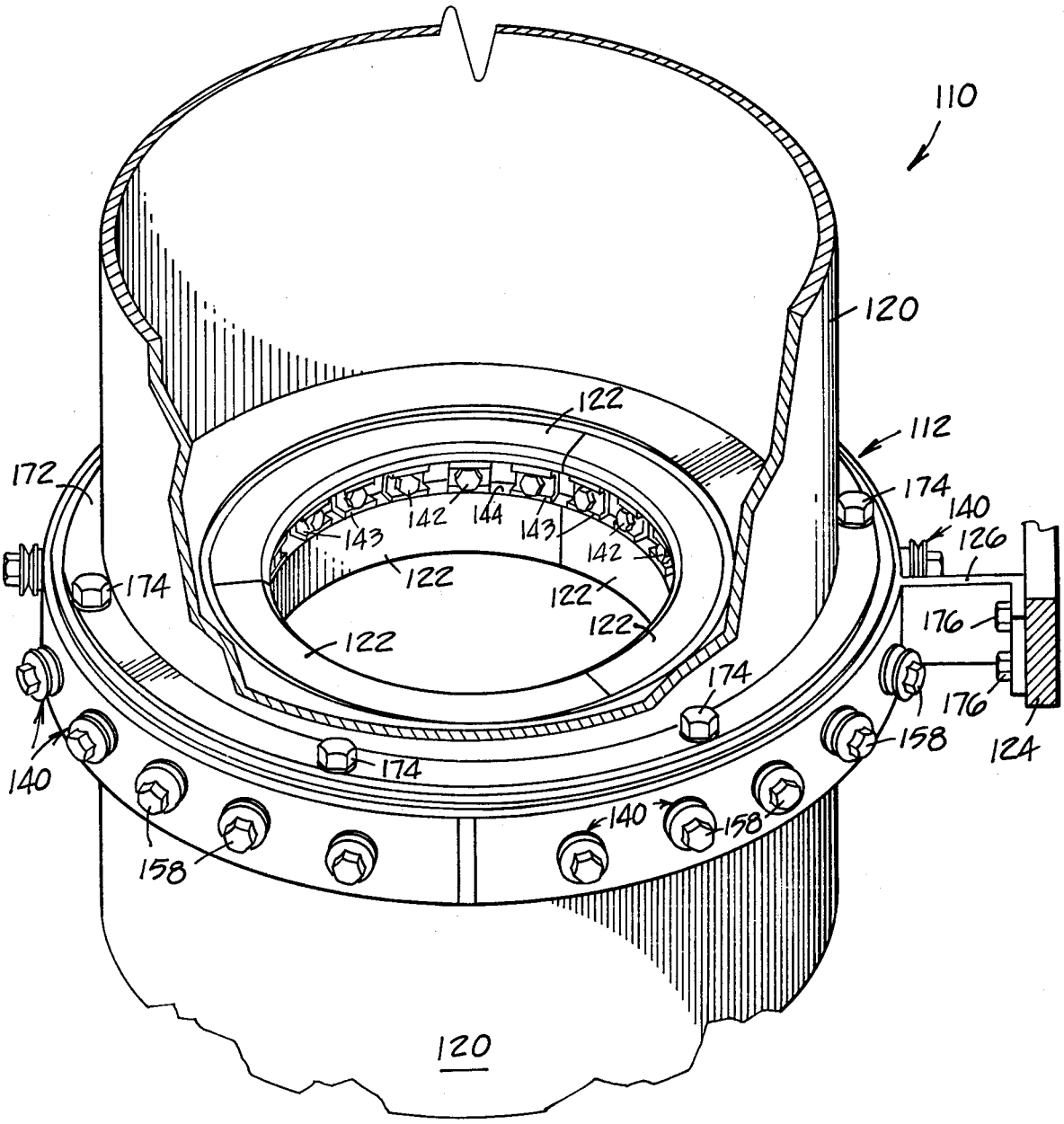
FIG. 3 is a perspective view of an additional embodiment of the invention.

An additional embodiment of the invention is illustrated in FIG. 3. The embodiment of FIG. 3 includes generally similar components as were described above for the embodiment of FIGS. 1 and 2. Accordingly the corresponding components in the embodiment of FIG. 3 are identified by similar numerical labels preceeded by the additional digit "1".

The embodiment of FIG. 3 differs from that of FIGS. 1 and 2 primarily that it includes a more limited number of heating element segments 122, each of the heating element segments being secured in electrically conductive relation with the ring element (in the same manner illustrated in FIG. 2) by means of a plurality of elongated bolts 136 and associated spring mechanisms 140. As with the embodiment of FIGS. 1 and 2, the tension of each spring mechanism may be individually adjusted. However, each of the heating element segments 122 is urged into electrically conductive relation with the ring element by a plurality of the spring mechanisms.

As may also be seen in FIG. 3, the cylindrical furnace wall portions 120 include flanges 172 which are secured to the electrode ring structure 112 by bolts 174. The furnace wall portions 120 extend above and or below the electrode ring structure 112 to form a cylindrical high temperature furnace. For example, the coating apparatus referred to above may be arranged within the furnace interior for performing coating operations at high temperatures. The length and inside diameter of the furnace may be varied according to requirements for the coating apparatus. The length of the individual heating element segments 122 may also be varied. In particular, they may be substantially longer along the axis of the furnace in order to heat a substantial portion of the furnace interior.

As is also illustrated in FIG. 3, the segments of the electrode ring 18 are secured for example by welding to respective connecting elements such as that indicated at 126. Each connecting element is in turn secured to a bus bar 124 by means of bolt 176.

Accordingly, there has been disclosed a heating element and electrode assembly providing for the effectively constant maintenance of an electrical connection between heating elements arranged inside a high temperature furnace and an external bus bar. Various modifications of the invention in addition to those shown and described above are believed apparent within the scope of the invention is defined only by the following claims.

What is claimed is:

1. An assembly for maintaining an interconnection between a heating element arranged in a high temperature furnace and an external bus bar, comprising an electrode means arranged in a wall of the furnace, said electrode means including external means for connection with the bus bar, an internal conductive surface connected with said external means while being arranged for abutting engagement with the heating element and an opening extending between said internal surface and an external surface of said electrode means, an elongated member effectively engaged with the heating element and movably arranged in said opening, and adjustable spring means arranged adjacent the external surface of said electrode means and connected to said elongated member for urging the heating element into intimate electrically conductive relation with said internal conductive surface.

2. The assembly of claim 1 wherein said elongated member comprises a bolt engaging the heating element and threadedly engaging a spring retainer with spring means being arranged for interaction between the spring retainer and the external surface of said electrode means.

3. The assembly of claim 2 further comprising a spring adapter engaging the external surface of said electrode means wherein said spring means comprises at least one spring member arranged between said spring adapter and said spring retainer.

4. The assembly of claim 1 wherein said adjustable spring means comprises a threaded spring retainer engaging said elongated member with spring means arranged for interaction between said spring retainer and the external surface of said electrode means.

5. The assembly of claim 1 wherein a plurality of elongated members are engaged with each heating element and movably arranged in respective openings in said electrode means, a separate adjustable spring means being connected with each of said elongated members for urging the heating element into engagement with said internal conductive surface of said electrode means.

6. A heating element and electrode ring assembly for use in a fuel particle coating furnace, to maintain an effective connection between a plurality of heating element segments and a bus bar means outside the furnace, comprising, an electrode ring forming a peripheral wall portion of the furnace and having external means connected with the bus bar means, said electrode ring forming an internal conductive surface connected with said external means and a plurality of radially arranged, circumferentially spaced-apart openings each extending between said internal surface and an external surface of said electrode ring, a plurality of the heating element segments being circumferentially arranged along said internal surface, an elongated member being engaged with each heating element segment and arranged in a respective one of said openings, and a plurality of adjustable spring means arranged adjacent the external surface and respectively engaged with said elongated members for urging the heating element segments into intimate, electrically conductive relation with said internal conductive surface.

7. The heating element and electrode ring assembly of claim 6 wherein each elongated member comprises a bolt engaging the respective heating element segment and threadedly engaging a spring retainer with spring means being arranged for interaction between the spring retainer and the external surface of said electrode ring.

8. The heating element and electrode ring assembly of claim 7 further comprising a spring adapter engaging the external surface of said electrode ring and wherein each spring means comprises at least one spring member arranged between said respective spring adapter and said spring retainer.

9. The heating element and electrode ring assembly of claim 6 wherein each adjustable spring means comprises a threaded spring retainer engaging a respective elongated member with spring means arranged for interaction between said spring retainer and the external surface of said electrode means.

10. The heating element and electrode ring assembly of claim 6 wherein said electrode ring comprises an annular conductive ring element with insulating plate means for mounting the conductive ring element in the furnace wall, the conductive ring element also forming passages for the circulation of coolant to limit conduction of heat from the heating elements to the external surroundings of the furnace.

11. The heating element and electrode ring assembly of claim 6 wherein a plurality of elongated members are engaged with each heating element and movably arranged in respective openings in said electrode means, a separate adjustable spring means being connected with each of said elongated members for urging the heating element into engagement with said internal conductive surface of said electrode means.

* * * * *